US007257360B2

(12) United States Patent
Domoto et al.

(10) Patent No.: US 7,257,360 B2
(45) Date of Patent: Aug. 14, 2007

(54) INDUCTION HEATED HEAT PIPE FUSER WITH LOW WARM-UP TIME

(75) Inventors: Gerald A. Domoto, Briarcliff Manor, NY (US); Nicholas Kladias, Athens (GR)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 10/749,284

(22) Filed: Dec. 30, 2003

(65) Prior Publication Data

US 2005/0141931 A1 Jun. 30, 2005

(51) Int. Cl.
*G03G 15/20* (2006.01)
*H05B 6/14* (2006.01)

(52) U.S. Cl. ..... 399/328; 219/619; 399/330

(58) Field of Classification Search ..... 219/216, 219/619; 399/328, 330, 334, 333
See application file for complete search history.

(56) References Cited

U.S. PATENT DOCUMENTS 4,512,650 A 4/1985 Kocher
4,515,466 A 5/1985 Heisler
5,063,404 A 11/1991 Milillo
5,893,666 A 4/1999 Aslam et al.
5,907,348 A 5/1999 Ogasawara et al.
5,984,848 A * 11/1999 Hyllberg et al. ..... 492/46
5,990,458 A 11/1999 Hyllberg et al.
6,042,985 A 3/2000 Matsuda et al.
6,113,212 A 9/2000 Ng
6,212,352 B1 4/2001 Kagawa et al.
6,285,006 B1 9/2001 Hyllberg
6,339,211 B1 1/2002 Foote et al.
6,359,880 B1 3/2002 Curry et al.
6,393,245 B1 5/2002 Jia et al.
6,445,902 B1 9/2002 Hirst et al.
6,577,839 B2 6/2003 Samei
6,580,895 B2 * 6/2003 Hirst et al. ..... 399/330
6,580,896 B2 * 6/2003 Lee ..... 399/330
6,584,298 B2 * 6/2003 Omoto et al. ..... 399/330
6,591,082 B2 7/2003 Samei et al.

FOREIGN PATENT DOCUMENTS

JP 11-282294 * 10/1999

* cited by examiner

*Primary Examiner*—Hoang Ngo
(74) *Attorney, Agent, or Firm*—Fay Sharpe LLP

(57) ABSTRACT

A fusing station (100) for fusing toner to an image receiving medium (102) includes: a fuser roller (120) configured as a heat pipe including a sealed hollow cavity (124) containing a working fluid; a pressure roller (140) that forms a nip with the fuser roller (120) through which the image receiving medium (102) passes; and, an electrical coil (128) inductively coupled to the fuser roller (120) to inductively heat the fuser roller (120) upon energizing the electrical coil (128) with electrical power.

15 Claims, 3 Drawing Sheets

INDUCTION HEATED HEAT PIPE FUSER WITH LOW WARM-UP TIME

BACKGROUND

The present inventive subject matter relates to the document printing arts. It is particularly applicable to marking engines, such as printers, copiers, facsimile machines, multifunction machines, xerographic devices, etc., and it will be described with particular reference thereto. However, application is also found in connection with other marking engines and/or implementations.

Some marking engines apply toner on a page or sheet of paper or other suitable image receiving medium (e.g., transparencies, etc.) to form an image thereon. Commonly, after the toner is applied, a process known as hot roll fusing uses heat and pressure to bond or fuse the toner to the page thereby fixing the image thereon.

For example, FIG. 1 shows a typical hot roll fusing station or assembly 10. The station 10 includes a fuser roller 12 and a pressure roller 14 that rotate in the directions of arrows 15 and 16, respectively. The fuser roller 12 commonly takes the form of a hollow tube 17 containing a heating element, usually a quartz rod or lamp 18, which heats up when electrical power is supplied thereto. Generally, the fuser roller 12 has a hard metal tube 17 that may be coated with Teflon® or a soft vinyl, and the heat from heating element is conducted from the rod or lamp 18 to the surface of the roller tube 17.

In hot roll fusing, the page 20 with dry toner particles thereon moves between the two rollers 12 and 14. The pressure roller 14, usually having a silicone rubber outer layer, presses the page 20 against the fuser roller 12. When the page 20 passes between the rolls, the heat of the fuser roller 12 and pressure applied by the pressure roller 14 melts the toner and fuses it to the page 20. The pressure roller 14 ensures that the page 20 is pressed against—and a little around—the fuser roller 12. This helps force the melted toner into the page. If the pressure roller 14 were a hard roller, the page 20 would be against the heated fuser roller 12 at only one point on the roll. On the other hand, a softer pressure roller 14 conforms the page 20 to the curved shape of the fuser roller 12 and ensures long enough contact therewith to completely melt the toner. This contact region is referred to as the nip and can be described by an amount of pressure thereat and/or the area of contact, e.g., a width in the direction of page movement and a length in the axial direction or direction normal to that of page movement.

It is generally advantageous to carefully control the temperature of the fuser roller 12 so that enough heat is supplied to melt the toner into the page 20 but not so much that it could damage the image. However, axial temperature uniformity tends to be difficult to achieve with traditional fuser rollers 12. Relatively cooler spots along the axial length of the fuser roller 12 can result in ineffective melting of the toner at that axial position, and relatively hotter spots along the axial length of the fuser roller 12 can result in image damage at that axial location. Accordingly, in an effort to address this issue, some marking engines employ two or more fusing stations 10 or quartz lamps 18 of different axial lengths to handle pages of different widths. Such implementations however can be disadvantageous as the separate independent fusing stations 10 or quartz lamps 18 present added production cost and/or other drawbacks that normally attend the use of additional components.

It is also generally advantageous that the fuser roller 12 be sufficiently stiff so as not to deform under the pressure of the pressure roller 14. Such deformation can result in distortions to the image. In an effort to address this issue, traditionally the tube 17 of the fuser roller 12 has been constructed with a suitably thick wall and/or reinforcements therefor. However, this solution tends to increase the thermal mass of the fuser roller 12 thereby disadvantageously increasing the warm-up time as compared to an otherwise similar fuser roller 12 with a relatively thinner tube wall and/or less or no reinforcements. That is to say, the thicker the wall is and/or the more reinforcements that are used, then the higher the thermal mass the fuser roller 12 will have, and hence, a greater warm-up time.

The present inventive subject matter contemplates a new and improved hot roll fusing station and/or hot roll fusing method that overcomes the above-mentioned limitations and others.

SUMMARY

In accordance with one aspect, a fusing station is provided for fusing toner to an imaging receiving medium. The fusing station includes: a fuser roller configured as a heat pipe including a sealed hollow cavity containing a working fluid; a pressure roller that forms a nip with the fuser roller through which the image receiving medium passes; and, an electrical coil inductively coupled to the fuser roller to inductively heat the fuser roller upon energizing the electrical coil with electrical power.

In accordance with another aspect, a method of fusing toner to an image receiving medium includes: inductively heating a heat pipe including a sealed hollow cavity containing a working fluid; and, applying heat from the heat pipe to a page of toner carrying image receiving medium.

In accordance with yet another aspect, a fusing station for fusing toner to an image receiving medium includes: distribution means for evenly distributing heat; means for inductively heating the distribution means; and, means for pressing a page of toner carrying image receiving medium to the heat distribution means.

Numerous advantages and benefits of the present inventive subject matter will become apparent to those of ordinary skill in the art upon reading and understanding the present specification.

BRIEF DESCRIPTION OF THE DRAWINGS

The present invention may take form in various components and arrangements of components, and in various steps and arrangements of steps. The drawings are only for purposes of illustrating preferred embodiments and are not to be construed as limiting. Further, it is to be appreciated that the drawings are not to scale.

DETAILED DESCRIPTION OF PREFERRED EMBODIMENTS

For clarity and simplicity, the present specification shall refer to structural and/or functional elements and/or components that are commonly known in the art and/or understood by those of ordinary skill without further detailed explanation as to their configuration or operation except to the extent they have been modified or altered in accordance with and/or to accommodate the preferred embodiment(s) presented herein.

Figure 1:
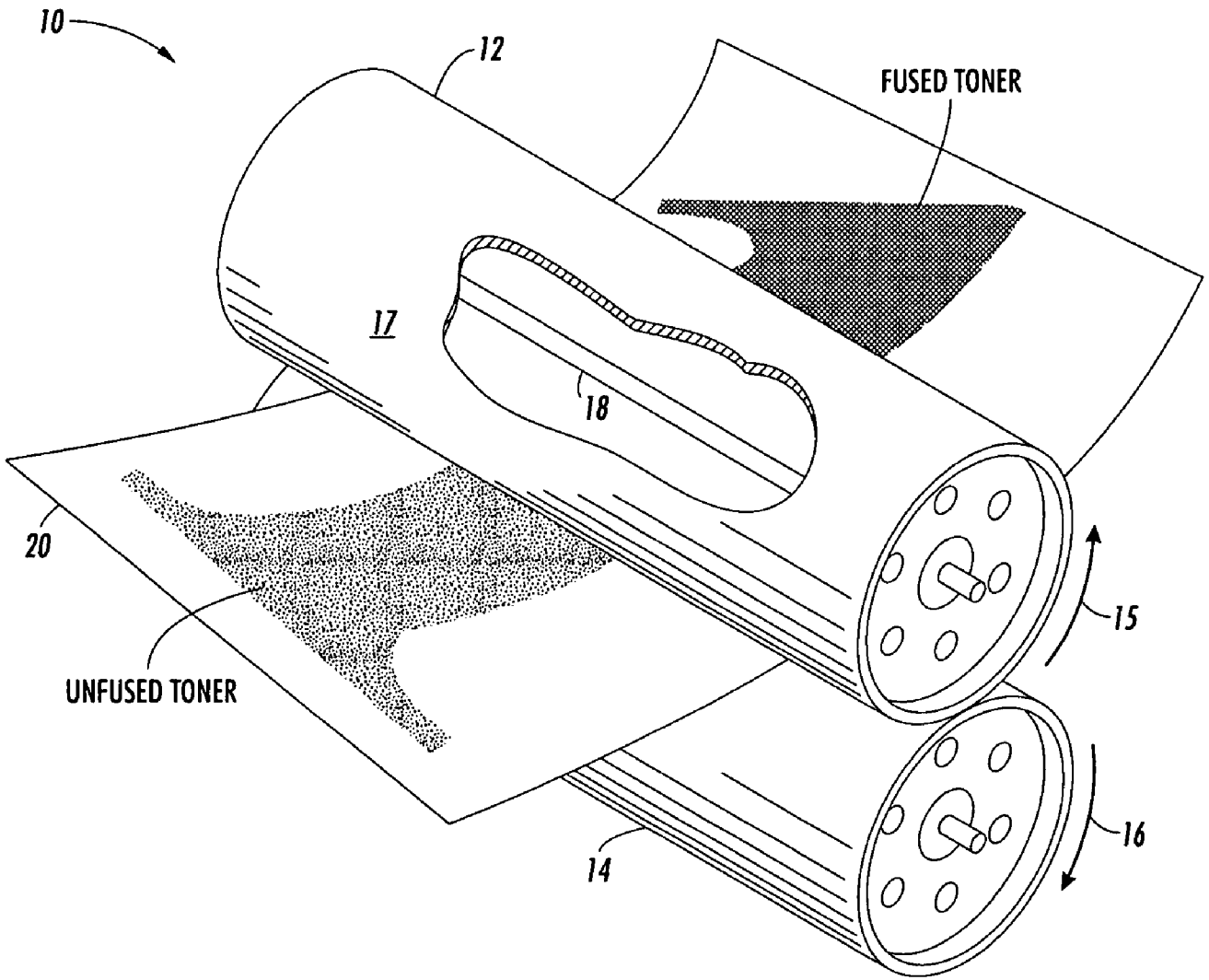
FIG. 1 is a diagrammatic illustration showing a conventional hot roll fusing station, with a portion of the fuser roller cut away.
Figure 2:
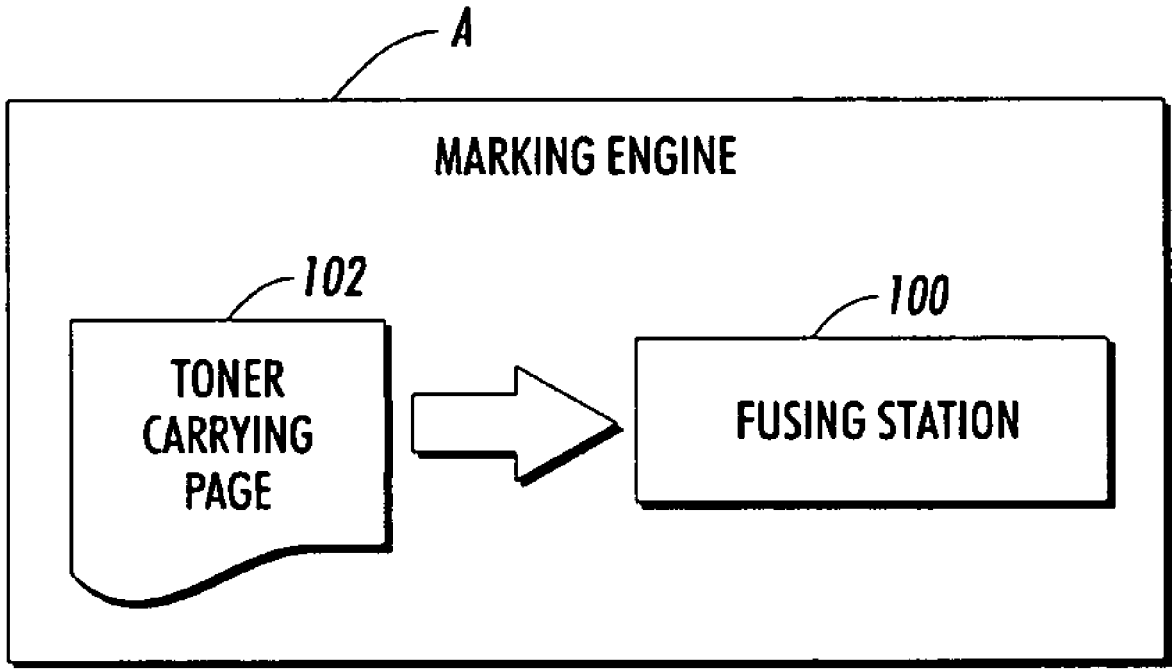
FIG. 2 is a diagrammatic illustration showing a marking engine incorporating an exemplary hot roll fusing station embodying aspects of the present inventive subject matter.

With reference to FIG. 2, a marking engine A includes a fusing station or assembly 100. The marking engine A is optionally a printer, copier, facsimile machine, multifunction machine, xerographic device, or the like. The marking engine A transfers and/or deposits toner onto a page or sheet of image receiving medium 102 (e.g., paper, transparency, etc.) to form an image thereon. After the toner is applied, the fusing station 100 receives the page 102 and performs a hot roll fusing process that uses heat and pressure to fuse the toner to the page 102 thereby fixing the image thereon. While only a single fusing station 100 is depicted for clarity and simplicity herein, it is to be appreciated that optionally a plurality of similar fusing stations are likewise incorporated in the marking engine A to handle fusing of various different medium types, or as otherwise desired for different fusing applications. However, a single fusing station 100 suitably handles image receiving medium having a plurality of different widths.

Figure 3:
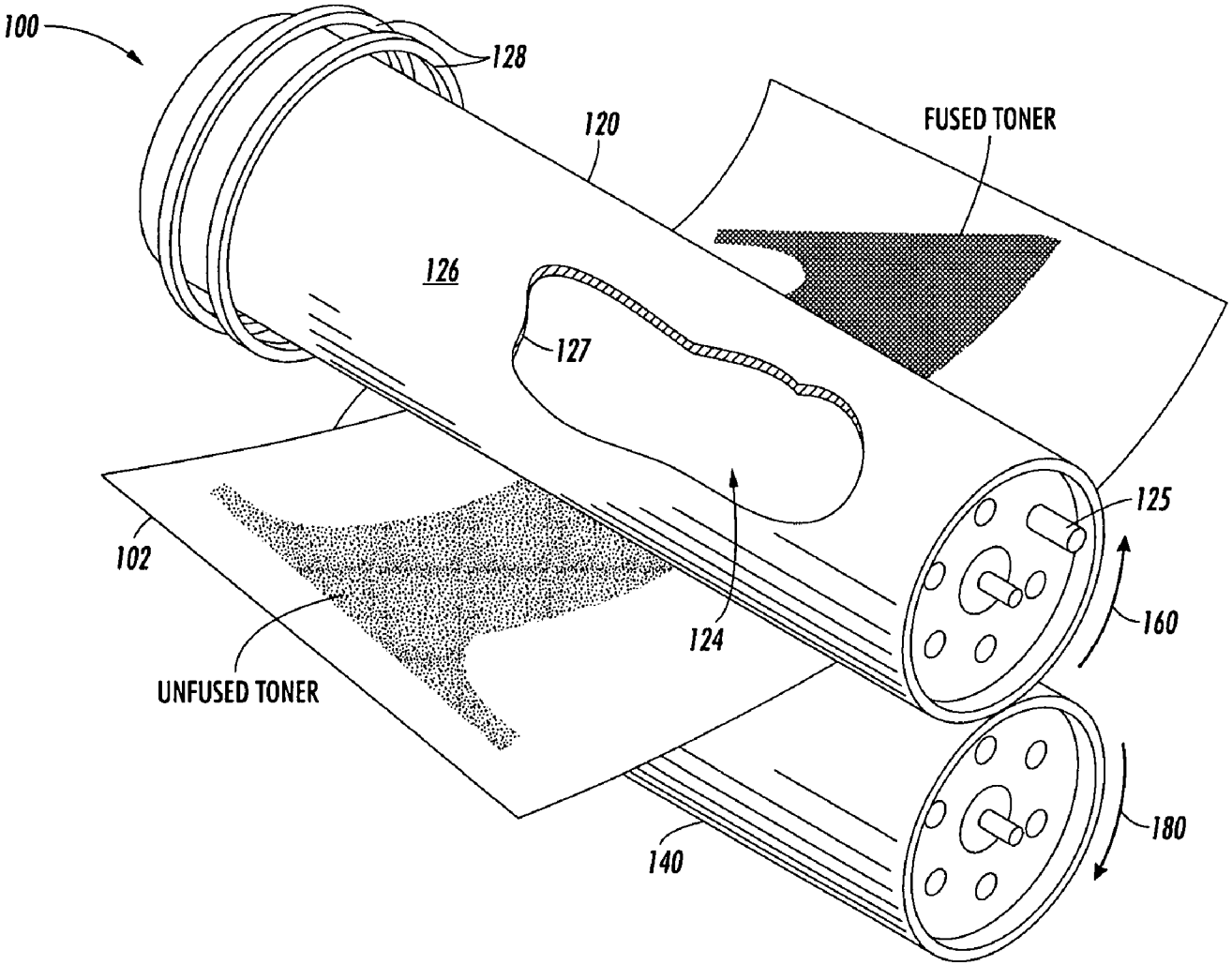
FIG. 3 is a diagrammatic illustration showing an exemplary hot roll fusing station embodying aspects of the present inventive subject matter, with a portion of the fuser roller cut away.

With reference to FIG. 3, the fusing station 100 includes a fuser roller 120 and a pressure roller 140 that are rotated in the directions of arrows 160 and 180, respectively. The fuser roller 120 is configured as a heat pipe including a sealed hollow cavity 124 containing a working fluid. Suitably, the cavity 124 is evacuated to form a substantial vacuum therein with the exception of the working fluid. The working fluid is optionally water, methanol, a combination thereof or another suitable working fluid. The working fluid is a multiphase mixture, with the liquid phase and the corresponding vapor phase in equilibrium. As heating is applied, both the temperature T and pressure p of the working fluid rise following the equilibrium pressure-temperature curves for the working fluid. For example, with water as the working fluid: at T=70° F., p=0.363 psia; at T=212° F., p=14.7 psia; at T=350° F., p=135 psia; and, at T=400° F., p=247 psia. Optionally, the fuser roller 120 is equipped with a pressure relief system (e.g., including a automatic pressure release valve 125) to protect against over pressurization.

As shown, the fuser roller 120 is a hollow cylindrical tube 126 (e.g., around 350 mm in axial length and 35 mm in diameter) capped at both ends to form the cavity 124 therein and contain the working fluid. However, the heat pipe is optional configured otherwise. For example, the cavity containing the working fluid is optionally formed between two walls of a double walled cylinder, the heat pipe may include multiple cavities, or some other suitable configuration. The wall 127 (e.g., around 0.3 mm in thickness) of the tube 126 is suitably steel or some other metal or electrically conductive material which is optionally coated on the outside with Teflon®, a soft vinyl or the like. Optionally, the wall 127 is formed from a magnetic material, or alternately, a ceramic, high temperature polymer or like material having magnetic particles embedded or otherwise incorporated therein.

One or more electrical coils 128 are inductively coupled to the fuser roller 120 such that when the coils 128 are electrically energized the fuser roller 120 is inductively heated. Notably, inductive heating provides a rapid response as compared to other conventional heating means. In the case of an electrically conductive magnetic walled tube 126 (e.g., steel or iron), inductive heating results from a combination of induced eddy currents and magnetic hysteresis; in the case of an electrically conductive nonmagnetic walled tube 126 (e.g., a nonmagnetic metal), inductive heating results from induced eddy currents; and, in the case of a nonconductive magnetic walled tube 126 (e.g., a ceramic, high temperature polymer or like material having magnetic particles embedded or otherwise incorporated therein), heating results from magnetic hysteresis. Suitably, the inductive heating produces an operating temperature between 350° F. and 400° F.

Sufficiently, as shown, the electrical coils 128 coaxially surround one end of the tube 126. Alternately, however, the coils 128 are optionally arranged differently, e.g., around or near one or both ends of the fuser roller 120, longitudinally around the fuser roller 120, or as otherwise suitable for inductive coupling with the fuser roller 120.

The pressure roller 140, e.g., with an outer layer of silicone rubber, forms a nip with the fuser roller 120. In a hot roll fusing operation, the page 102 with toner particles thereon is drawn and/or passes through the nip between the two rollers 120 and 140 as they are rotated. The pressure roller 140 presses the page 102 against the fuser roller 120, e.g., with a nip pressure of around 19 psi. When the page 102 passes between the rolls, the heat of the fuser roller 120 and pressure applied by the pressure roller 140 melts or softens the toner and fuses it to the page 20. The pressure roller 140 ensures that the page 102 is pressed against—and a little around—the fuser roller 120 so as to help force the melted or softened toner into the page 102. Suitably, the pressure roller 140 is soft enough to conform the page 102 to the shape of the fuser roller 120 and ensure long enough contact therewith to sufficiently melt or soften the toner, e.g., a nip width of around 14 mm in the direction of page movement.

In modeling, an exemplary fusing station, similar to the one illustrated in FIG. 3, exhibited substantial temperature uniformity along its axial direction aided by the even temperature distributing properties of the heat pipe. Additionally, significant stiffening of the fuser roller was exhibited in a modeled heat pipe fuser roller with a 0.3 mm steel tube wall with a Young's modulus of $209\times10^9$ Pascals and a Poisson ration of 0.3, an axial length of 350 mm, and a diameter of 35 mm. The observed stiffening accompanied an internal pressure load of 169 psi within the heat pipe. The modeling included a 19 psi external nip pressure load on the tube wall and a 14 mm nip width in the direction of page movement. Comparatively, a like and similarly situated non-heat pipe fuser roller (i.e., with no internal pressure load) exhibited deformation up to 0.68 mm, while the deformation of the internally pressurized heat pipe fuser roller was limited to 0.26 mm. These results demonstrate and/or suggest that the internally pressurized heat pipe fuser roller accommodates a relatively thinner wall as compared to non-heat pipe fuser rollers (i.e., non-internally pressurized fuser rollers) while maintaining undesirable deformation within acceptable limits. Consequently, the relatively thinner wall translates to lower thermal mass and therefore to a shorter warm-up time.

Thermally, the heat capacity of the modeled fuser roll is approximately 41.5 J/° C. If water is the working fluid, it is estimated the amount giving a 2 mm depth is 7.5 $mm^3$ and has a heat capacity of 31.5 J/° C. Using 1000 watts to heat the heat pipe and having a standby temperature of 190° C., the warm-up time is estimated as 12.4 seconds. Additionally, the fuser roller operating temperature can be raised at a rate of 13.7° C./sec, e.g., accommodating changing to a thick paper mode in a few seconds. Accordingly, as those of ordinary skill in the art will understand from reading the present specification, the inductively heated heat pipe fuser roller described herein exhibits substantial axial temperature uniformity and significantly reduces warm-up time while limiting undesirable deformations.

It is to be appreciated that in connection with the particular exemplary embodiments presented herein certain structural and/or function features are described as being incorporated in defined elements and/or components. However, it is contemplated that these features may, to the same or similar benefit, also likewise be incorporated in other elements and/or components where appropriate. It is also to be appreciated that different aspects of the exemplary embodiments may be selectively employed as appropriate to achieve other alternate embodiments suited for desired applications, the other alternate embodiments thereby realizing the respective advantages of the aspects incorporated therein.

Additionally, it is to be appreciated that certain elements described herein as incorporated together may under suitable circumstances be stand-alone elements or otherwise divided. Similarly, a plurality of particular functions described as being carried out by one particular element may be carried out by a plurality of distinct elements acting independently to carry out individual functions, or certain individual functions may be split-up and carried out by a plurality of distinct elements acting in concert. Alternately, some elements or components otherwise described and/or shown herein as distinct from one another may be physically or functionally combined where appropriate.

In short, the present inventive subject matter has been described with reference to preferred embodiments. Obviously, modifications and alterations will occur to others upon reading and understanding the specification. It is intended that the invention be construed as including all such modifications and alterations insofar as they come within the scope of the appended claims or the equivalents thereof.

What is claimed is:

1. A fusing station for fusing a marking agent to an imaging receiving medium, said fusing station comprising:

a fuser roller configured as a heat pipe, a cylindrical wall of the fuser roller being formed from an electrically conductive material having a thickness less than or equal to approximately 0.3 mm and defining a sealed hollow cavity containing a working fluid whereby in operation, the wall is pressurized by the fluid;

a pressure roller that forms a nip with the fuser roller through which the image receiving medium passes; and, an electrical coil inductively coupled to the wall of the fuser roller to inductively heat the wall of the fuser roller upon energizing the electrical coil with electrical power, wherein the electric coil surrounds an outer periphery of the fuser roll.

2. The fusing station of claim 1, wherein the heat pipe has an internal pressure load that substantially stiffens the same against deformation.

3. The fusing station of claim 2, wherein the internal pressure load is applied by the working fluid having a pressure greater than or equal to approximately 135 psia at a designated operating temperature.

4. The fusing station of claim 3, wherein the designated operating temperature is between approximately 350° F. and approximately 400° F. inclusive.

5. The fusing station of claim 1, wherein the working fluid is methanol, or a combination of water and methanol.

6. The fusing station of claim 1, wherein a wall of the fuser roller is formed from a magnetic material.

7. The fusing station of claim 1, wherein a wall of the fuser roller is formed from a nonconductive material having magnetic particles embedded therein.

8. The fusing station of claim 1, wherein the fuser roller is equipped with a pressure relief system to protect against over pressurization.

9. The fusing station of claim 8, wherein the pressure relief system includes an automatic pressure release valve.

10. A method of fusing a marking agent to an image receiving medium, said method comprising:

inductively heating a wall of a heat pipe, the wall defining a sealed hollow cavity containing a working fluid; and, applying heat from the heat pipe to a page of the image receiving medium carrying the marking agent thereon including contacting the page with the heat pipe;

wherein the step of inductively heating includes electrically energizing an electrical coil inductively coupled to and surrounding an outer periphery of the heat pipe.

11. The method of claim 10, wherein the inductive heating is achieved via production of magnetic hysteresis or a combination of magnetic hysteresis and eddy currents in a wall of the heat pipe.

12. The method of claim 10, further comprising:

internally pressurizing the heat pipe with the working fluid, said working fluid having a pressure greater than or equal to approximately 135 psia at a designated operating temperature.

13. A fusing station for fusing toner to an image receiving medium, said fusing station comprising:

distribution means for evenly distributing heat, said heat distribution means including a heat pipe;

means for inductively heating the distribution means, wherein the means for inductively heating includes an electrical coil inductively coupled to and surrounding an outer periphery of an end of the heat pipe; and, means for pressing a page of toner carrying image receiving medium to a portion of the heat pipe spaced from the end.

14. The fusing station of claim 13, wherein the heat pipe includes a sealed hollow cavity containing a working fluid.

15. The fusing station of claim 13, wherein a wall of the fuser roller is formed from a material having a thickness less than or equal to approximately 0.3 mm.

* * * * *